US011359775B2

(12) United States Patent
Li et al.

(10) Patent No.: US 11,359,775 B2
(45) Date of Patent: Jun. 14, 2022

(54) SERIES CONNECTED PARALLEL ARRAY OF LEDS

(71) Applicant: Ledup Manufacturing Group Limited, Irwindale, CA (US)

(72) Inventors: Franco Li, Irwindale, CA (US); Jing Jing Yu, Irwindale, CA (US)

(73) Assignee: Ledup Manufacturing Group Limited, Irwindale, CA (US)

( * ) Notice: Subject to any disclaimer, the term of this patent is extended or adjusted under 35 U.S.C. 154(b) by 0 days.

(21) Appl. No.: 17/235,133

(22) Filed: Apr. 20, 2021

(65) Prior Publication Data

US 2021/0388955 A1 Dec. 16, 2021

Related U.S. Application Data

(60) Provisional application No. 63/037,390, filed on Jun. 10, 2020.

(51) Int. Cl.

| | |
|---|---|
| ***F21S 4/26*** | (2016.01) |
| ***H05B 45/345*** | (2020.01) |
| ***H05B 45/52*** | (2020.01) |
| ***F21Y 115/10*** | (2016.01) |

(52) U.S. Cl.

CPC ..... *F21S 4/26* (2016.01); *H05B 45/345* (2020.01); *H05B 45/52* (2020.01); *F21Y 2115/10* (2016.08)

(58) Field of Classification Search

CPC ..... F21S 4/10; F21S 4/26; F21Y 2115/10; H05B 45/345; H05B 45/52

See application file for complete search history.

(56) References Cited

U.S. PATENT DOCUMENTS

| | | | | |
|---|---|---|---|---|
| 8,823,270 | B2 | 9/2014 | Yu | |
| 2018/0020520 | A1* | 1/2018 | Harris | H05B 47/16 |
| 2019/0104578 | A1* | 4/2019 | Tsai | H01L 33/62 |
| 2019/0364632 | A1* | 11/2019 | Parker, II | H05B 45/10 |
| 2020/0284403 | A1* | 9/2020 | Grave | F21V 23/06 |
| 2020/0400278 | A1* | 12/2020 | Shao | H01R 24/28 |

* cited by examiner

*Primary Examiner* — Peggy A Neils

(74) *Attorney, Agent, or Firm* — William W. Cochran; Cochran Freund & Young LLC

(57) ABSTRACT

Disclosed is a plurality of LED packages that are connected in a parallel array. A plurality of parallel arrays can also be connected in series to form a light string. The LED packages present a standardized impedance in which the resistive values of a series resistor and a parallel resistor are selected to moderate the flow of current when the LEDs become either shorted or open circuited.

5 Claims, 3 Drawing Sheets

SERIES CONNECTED PARALLEL ARRAY OF LEDS

BACKGROUND

LEDs have increasingly been used as luminance sources in various applications. One application where LEDs have become particularly popular in recent years is decorative light strings. Such light strings are usually formed from a plurality of LEDs connected in series and/or parallel, or some combination thereof.

SUMMARY

Present invention may therefore comprise a light emitting diode array having a light emitting diode package that moderates the flow of current through light emitting diodes in the light emitting diode package comprising: a light emitting diode in the light emitting diode package having an operating current, based on electrical characteristics of the light emitting diode, that provides proper operation of the light emitting diode; a parallel resistor that is connected in parallel with the light emitting diode; a series resistor connected in series with the light emitting diode and the parallel resistor, the series resistor having a resistive value that is greater than the parallel resistor so that current is moderated in the parallel array when the light emitting diode presents a short circuit or an open circuit; an encapsulating cover that surrounds the light emitting diode, the parallel resistor and the series resistor to form the light emitting diode package that is waterproof; a voltage supply connected to the light emitting diode package that supplies a sufficient DC voltage to the light emitting diode package to create the operating current in the light emitting diode based upon the resistive value of the series resistor and the resistive value of the parallel resistor; additional light emitting diode packages connected in parallel to the light emitting diode package to form the parallel array.

Present invention may further comprise a method of moderating the flow of current through a light emitting diode package upon the occurrence of a short circuit or open circuit of a light emitting diode in the light emitting diode package to reduce dimming and brightening of other light emitting diodes in other light emitting diode packages that are connected in parallel to the light emitting diode package comprising: providing the light emitting diode package having a series resistor that is connected in series with the light emitting diode and a parallel resistor that is connected in parallel with the light emitting diode; determining an operating current for the light emitting diode, based upon electrical characteristics of the light emitting diode, to provide proper operation of the light emitting diode; determining an impedance of the light emitting diode based upon the operating current of the light emitting diode; selecting a resistive value for the series resistor that is greater than a resistive value of the parallel resistor; selecting an operating voltage to be applied to the parallel array that is sufficient to supply the operating current to the light emitting diode based upon the resistive value of the series resistor, the resistive value of the parallel resistor and the impedance of the light emitting diode.

DETAILED DESCRIPTION OF THE EMBODIMENTS

Figure 1:
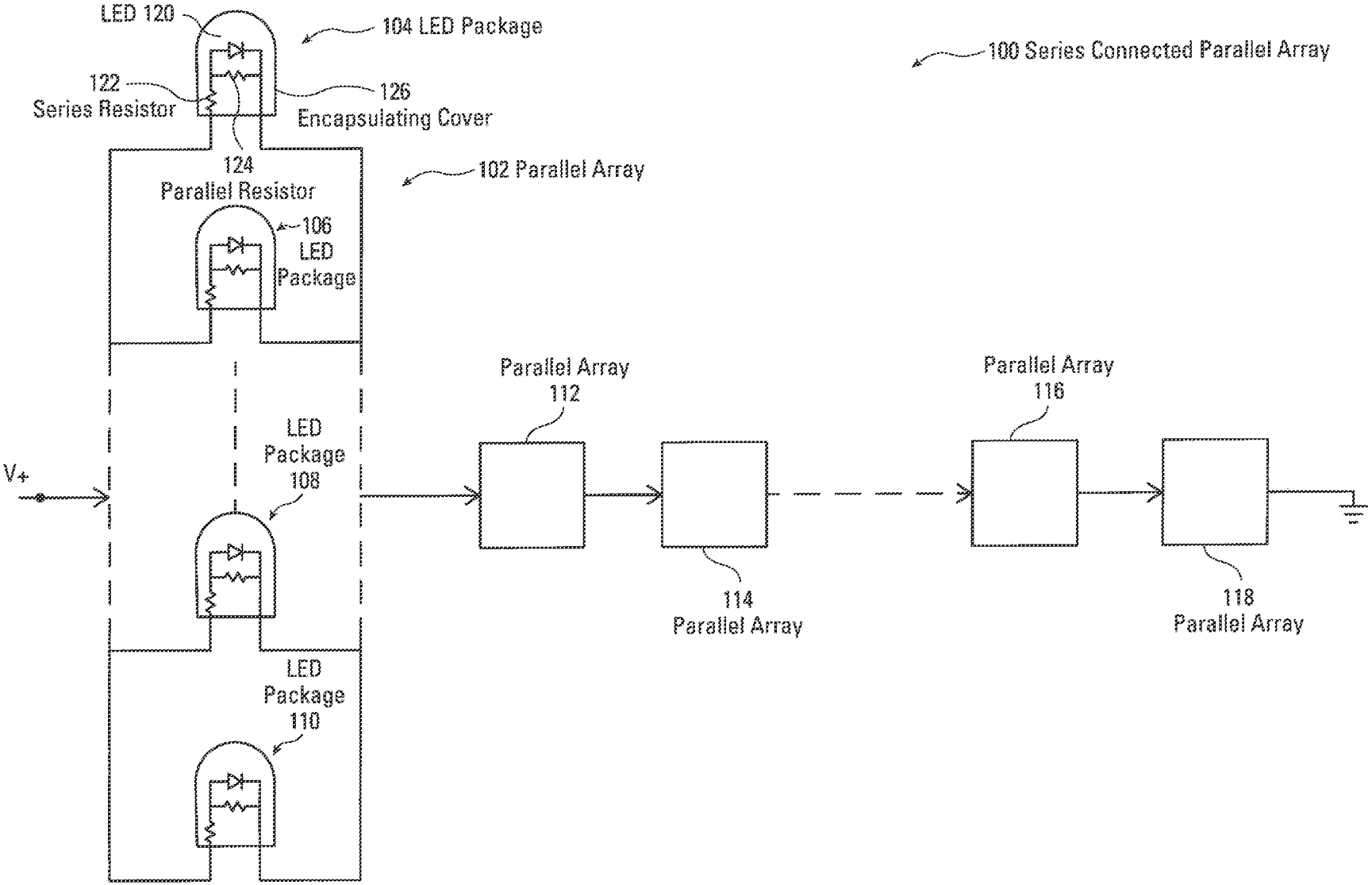
FIG. 1 is a schematic diagram of an embodiment of a series connected parallel array of LEDs.

FIG. 1 is a schematic block diagram of a series of connected parallel arrays 100 that utilize LED packages 104-110. LED packages 104-110 are placed in a parallel array, such as parallel array 102. The parallel array 102 may be utilized in various ways. For example, the parallel array 102 may be placed in a matrix or other geometrical design to create a single light source that has high intensity. In another application, the parallel array may be arranged in a waterfall configuration or icicle configuration as part of a light string. As illustrated in FIG. 1, a plurality of LED packages are connected in parallel, such as LED package 104, 106, 108, 110. The number of parallel connected LED packages may be large. For example, 100 or more LED packages may be used in some instances. Of course, the value of the resistors, such as series resistor 122 and parallel resistor 124, must be considered, as well as the DC voltage (V+) that is applied to the series connected parallel array 100, to ensure that a proper amount of current flows through each of the LEDs to illuminate the LEDs properly.

In that regard, the series resistor 122 and parallel resistor 124 are selected so that the LED package 104 and all of the LED packages have a standardized input impedance. Each of the LED packages 104, 106, 108, 110 use a series resistor and a parallel resistor that may have the same resistive values as series resistor 122 and parallel resistor 124 or different resistances if the LED in the LED package has a different impedance because of the use of different LEDs, such as color LEDs. In this manner, each of the LED packages 104, 106, 108, 110 have a standardized input impedance that is approximately the same (e.g., within about 10%), so that the same amount of current flows through each of the LEDs in the LED packages 104, 106, 108, 110 if the LEDs are of the same type, or different currents if the LEDs are a different type, such as different color LEDs. In that case, the values of the series and parallel resistors can be changed to produce approximately the same input impedance. In this manner, if an LED, such as LED 120, becomes shorted or forms an open circuit, the amount of light (lumins) produced by the LEDs in each of the other LED packages 106, 108, 110 remain substantially constant. This is explained in more detail below.

As also illustrated in FIG. 1, if each of the standardized input impedance LED packages 104, 106, 108, 110 have a standardized input impedance, the input impedance of the parallel array 102 can be easily calculated using the standard equation (Eq. 1) for parallel resistances.

$$R=R_1 \cdot R_2/(R_1+R_2) \qquad \text{(Eq. 1)}$$

where R is the equivalent resistance of a parallel array of $R_1$ and $R_2$.

The size of the series resistor 122 and the parallel resistor 124, illustrated in FIG. 1, are selected to moderate the flow of current through the LEDs in the LED packages 106, 108, 110 when LED 120 is either shorted or forms an open circuit. In that regard, the voltage (V+) is a DC voltage so that the LED 120 does not have imaginary impedance. The impedance of the LED 120 varies with the amount of current flowing through the LED. Although LEDs, such as LED 120, may not have a measurable resistance, the voltage drop across the connectors of an LED with an operating current that is sufficient to properly illuminate the LED 120 can be used to determine the impedance of the LED. When LED 120 forms an open circuit, the current will pass through the parallel resistor 124 as well as the series resistor 122. The equivalent resistance of the circuit, when the LED 120 is an open circuit, is the resistance of the series resistor 122 plus the parallel resistor 124. In that instance, to moderate the flow of current through the series resistor 122, the parallel resistor 124 should have a resistive value that is less than the resistive value of the series resistor and preferably have a low resistance compared to the resistive value of series resistor 122. The current through the series resistor 122 changes proportionally with the amount of added resistance from parallel resistor 124. When LED 120 becomes short circuited, parallel resistor 124 is essentially eliminated from the circuit so that the only resistance in the circuit is series resistor 122. Elimination of a small resistance would therefore not change the flow of current through series resistor 122 by a large amount. Again, the resistive value of parallel resistor 124 should be less than the resistive value of series resistor 122 and preferably the resistive value of the parallel resistor 124 should be low compared to the resistive value of series resistor 122. At the same time, the resistance of the parallel resistor 124 should be greater than the impedance of the LED 120, and preferably much greater than the impedance of LED 120, so that a primary portion of the current that flows through series resistor 122 also flows through LED 120. Since the parallel resistor 124 is in parallel with the LED 120, the amount of current flowing through the LED 120 is proportionally related to the impedance of LED 120 and parallel resistor 124.

As also illustrated in FIG. 1, additional parallel array packages 112-118 are connected in series with parallel array 102. For example, the series connected parallel array 100 may include parallel array 102, and parallel arrays 112, 114, 116 and 118 as illustrated in FIG. 1. Any desired number of parallel arrays can be connected in series as long as there is sufficient voltage (V+) and an adequate amount of current that can be supplied to the series connected parallel array 100.

By using LED packages, such as LED package 104, that have a designed input impedance, the design of the series connected parallel array 100 can be simplified. In this manner, the current flowing through each of the LEDs, when the LEDs are of the same type, in each of the parallel arrays 102, 112, 114, 116 and 118, is substantially the same (within about 10%) so that the illumination of each of the LEDs is substantially the same. If LEDs are used that are different colors, the resistance of series resistor 122 and parallel resistor 124 can be modified because of the particular characteristics of the different color LEDs to provide a standard input impedance. In this manner, a standard input impedance can be used for each of the LED packages to maintain a constant flow of current through the LED packages. Although LED packages have been used for replacement LEDs to ensure that replacement LEDs provide a constant illumination across an LED string, such as disclosed in U.S. Pat. No. 8,823,270 issued Sep. 2, 2014, which is specifically incorporated herein for all that it discloses and teaches, standardized input impedance LED packages have not been used in parallel arrays in hardwired circuits. Of course, the advantage of using LED package 104 in a parallel array is that either shorted or open circuited LEDs in the array moderate the change in the current flowing through the other LEDs in the parallel array. A change in current flowing through a particular LED in the parallel array 102 changes the amount of current flowing through the other LEDs in the parallel array, which could either cause the other LEDs in the array to dim or increase in brightness. If additional current flows through the other LEDs in the array, the lifetime of the LED is shortened and a safety hazard could be created. The parallel configuration of the parallel array 102, as well as the parallel connected resistor in each LED package 104-110, allows current to keep flowing in the series connected parallel array 100 if an LED in any of the LED packages 104-110 becomes an open circuit.

Further, the structure of the sockets and the mounting of the LED bulbs for replaceable LEDs is expensive and is prone to various problems. For example, the connections of replaceable bulbs in a light string are normally not waterproof. Corrosion can occur in the connections for replaceable bulbs, especially when light strings are used outdoors. Hardwired light strings with non-replaceable bulbs are easier and less expensive to construct and can provide waterproofing. In addition, the encapsulation using the encapsulating cover 126 greatly adds to the waterproofing of the LED package 104.

Figure 2:
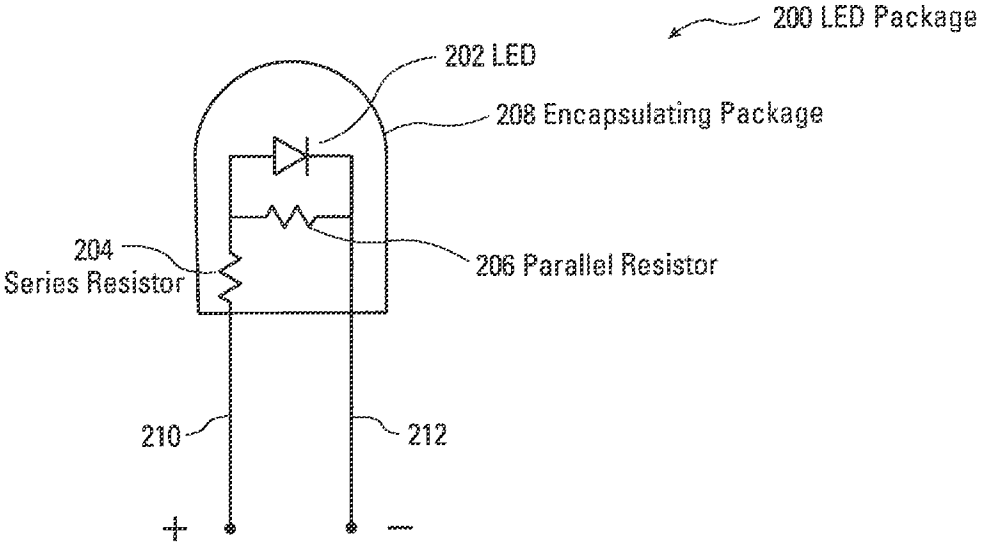
FIG. 2 is a schematic diagram of an embodiment of an LED package.

FIG. 2 is an illustration of LED package 200 that is disposed in an encapsulating package 208 that is made of epoxy or plastic material. A series resistor 204 is connected to the positive lead 210 of the LED package 200. The input impedance of the LED package 200 is the value of the series resistor 204 plus the parallel impedance of the LED 202 and parallel resistor 206. Since DC voltage (V+) is being used to drive the LED array package 200, LED 202 does not have imaginary impedance. Just as there is a voltage drop across forward biased standard diodes, there is also a voltage drop across LEDs such as LED 202. The impedance of the LED 202 can be determined by the voltage drop across the LED 202 divided by the current passing through the LED 202. Of course, this changes in accordance with the design of the circuit, including the values of the series resistor and parallel resistor, as well as the voltage applied to each LED package 200.

Figure 3:
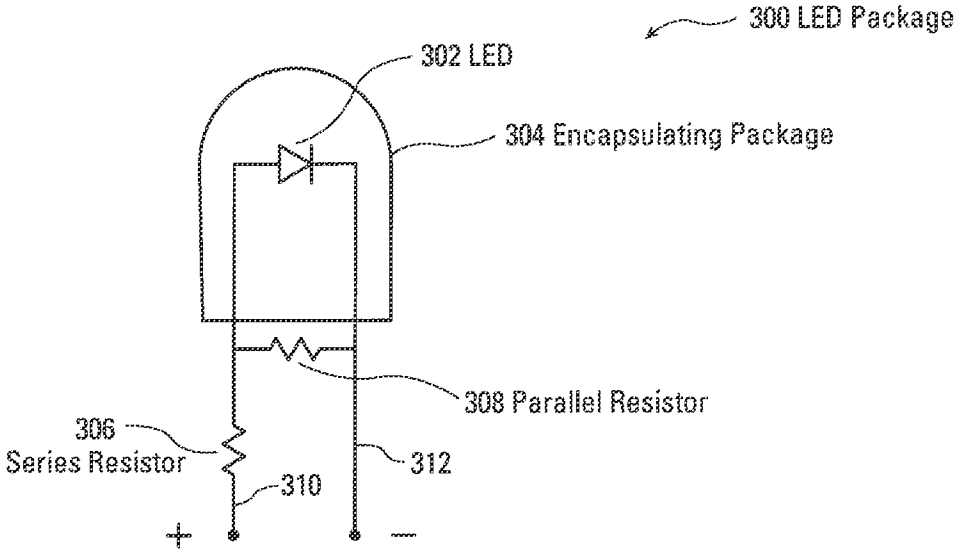
FIG. 3 is a schematic diagram of another embodiment of an LED package.

FIG. 3 illustrates another embodiment of an LED package 300. As illustrated in FIG. 3, the LED 302 is disposed in an encapsulating package 304 made of epoxy or plastic. The series resistor 306 and the parallel resistor 308 are connected to the leads 310, 312 outside of the encapsulating package 304. This allows the series resistor 306 and parallel resistor 308 to be added to the LED package 300 after the LED 302 has been formed and encapsulated in encapsulating package 304. The disadvantage of the LED package 300 of FIG. 3 is that since the epoxy or plastic does not encapsulate series resistor 306 and parallel resistor 308, the circuit is not waterproof. Of course, the advantage of the LED package 200 of FIG. 2 is that insulators do not have to be provided since the circuit is encased in the encapsulating package 208, and the circuit is waterproof.

The embodiments of the present invention therefore provide LED packages that are connected in parallel that present a substantially uniform input impedance despite the characteristics of individual LEDs. This causes an equal amount of current to flow through each of the LEDs to create a uniform lumination of the LEDs. The standardized input impedance circuit utilizes a parallel connected resistor that allows current to continue to flow when the LED becomes an open circuit. The circuit also has a series connected resistor that controls the flow of current when LEDs are shorted in the LED packages. As such, the LED packages handle both short and open circuits of the LED and are capable of moderating the flow of current through the parallel connected packages to reduce variations in dimming and brightness as a result of short circuiting or open circuiting of LEDs.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A light emitting diode parallel array having a plurality of light emitting diode packages connected in parallel that have a standardized input impedance and a circuit design that moderates the flow of current through said light emitting diode packages to reduce dimming and brightening of light emitting diodes in said plurality of light emitting diode packages and allows a constant flow of current in said light emitting diode parallel array, said light emitting diode parallel array comprising:

a first light emitting diode package having said standardized input impedance and a first circuit design comprising:

a first light emitting diode in said first light emitting diode package having an operating current, based on electrical characteristics of said light emitting diode, that causes said first light emitting diode to create a selected amount of illumination;

a parallel resistor that is connected in parallel with said first light emitting diode and has a resistive value greater than said first light emitting diode when said first light emitting diode is illuminated with said operating current;

a series resistor connected in series with said first light emitting diode and said parallel resistor, said series resistor having a resistive value that is greater than said parallel resistor so that a change in current is moderated in said first light emitting diode package when said first light emitting diode presents a short circuit or an open circuit;

an encapsulating cover that surrounds said light emitting diode, said parallel resistor and said series resistor to form said first light emitting diode package that is waterproof;

a voltage supply connected to said first light emitting diode package that supplies a sufficient DC voltage to said first light emitting diode package to create said operating current in said light emitting diode in said first light emitting diode package based upon said resistive value of said series resistor, said resistive value of said parallel resistor, a resistive value of additional light emitting diode packages connected in parallel with said first light emitting diode package and additional light emitting diode parallel arrays that may be connected in series to said light emitting parallel array;

said additional light emitting diode packages connected in parallel to said first light emitting diode package, said additional light emitting diode packages having circuit designs that are the same as said first circuit design, said additional light emitting diode packages having said standardized input impedance, regardless of the type of light emitting diode in said additional light emitting diode packages, that allows a constant flow of current through said additional light emitting diode packages when a light emitting diode package, of said plurality of light emitting diode packages, is replaced, and reduces brightening and dimming of light emitting diodes in said plurality of light emitting diode packages when a light emitting diode package is replaced.

2. The light emitting diode parallel array of claim 1 further comprising:

a plurality of additional light emitting diode parallel arrays that are connected in series with said light emitting diode parallel array to form a light string.

3. A method of moderating the flow of current through a light emitting diode parallel array having a plurality of light emitting diode packages connected in parallel, said light emitting diode packages having a standardized input impedance which reduces dimming and brightening of light emitting diodes in said plurality of light emitting diode packages if one or more of said light emitting diodes shorts or becomes an open circuit and allows a constant flow of current in said light emitting diode parallel array if a light emitting diode package, of said plurality of light emitting diode packages, is replaced comprising:

providing a first light emitting diode package, of said plurality of light emitting diode packages, having a standardized input impedance and a circuit design that comprises a first series resistor that is connected in series with said first light emitting diode and a first parallel resistor that is connected in parallel with said first light emitting diode;

selecting an operating current for said first light emitting diode to create a selected amount of illumination, based upon electrical characteristics of said first light emitting diode at said operating current;

determining an impedance of said first light emitting diode when said first light emitting diode is illuminated at said operating current;

selecting a resistive value for said first series resistor that is greater than a resistive value of said first parallel resistor;

selecting a resistive value for said first parallel resistor that is greater than said impedance of said first light emitting diode when said first light emitting diode is illuminated at said operating current;

selecting an operating voltage to be applied to said light emitting diode parallel array that is sufficient to supply said operating current to said first light emitting diode based upon said resistive value of said first series resistor, said resistive value of said first parallel resistor and said impedance of said first light emitting diode when said first light emitting diode is illuminated with said operating current, an input impedance of additional light emitting diode packages connected in parallel to said first light emitting diode package and an input impedance of additional light emitting diode parallel arrays that may be connected in series to said light emitting diode parallel array;

connecting said additional light emitting diode packages in parallel with said first light emitting diode package, said additional light emitting diode packages having a standardized input impedance and circuit design that are the same as said standardized input impedance and said circuit design of said first light emitting diode package.

4. The method of claim 3 further comprising:

connecting said additional light emitting diode parallel arrays in series to said light emitting diode parallel array.

5. The method of claim 4, further comprising:

selecting an input impedance of said additional light emitting diode packages to substantially match said input impedance of said light emitting diode package wherein at least one of said additional light emitting diode packages has an additional light emitting diode that has an impedance that is different from said light emitting diode.

* * * * *